US010407215B2

(12) United States Patent
Murray

(10) Patent No.: US 10,407,215 B2
(45) Date of Patent: Sep. 10, 2019

(54) CLEAR CONTAINER HOLDING MULTIPLE ARTICLES

(71) Applicant: Pouch Pac Innovations, LLC, Sarasota, FL (US)

(72) Inventor: R. Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 78 days.

(21) Appl. No.: 15/425,251

(22) Filed: Feb. 6, 2017

(65) Prior Publication Data

US 2017/0225838 A1 Aug. 10, 2017

Related U.S. Application Data

(60) Provisional application No. 62/291,575, filed on Feb. 5, 2016.

(51) Int. Cl.

| | |
|---|---|
| ***B65D 25/54*** | (2006.01) |
| ***B65D 73/00*** | (2006.01) |
| ***B65D 25/20*** | (2006.01) |
| ***B65D 5/42*** | (2006.01) |
| ***B65D 5/02*** | (2006.01) |

(52) U.S. Cl.

CPC ..... *B65D 25/54* (2013.01); *B65D 5/0254* (2013.01); *B65D 5/4266* (2013.01); *B65D 25/205* (2013.01)

(58) Field of Classification Search

CPC .... B65D 5/0254; B65D 5/4266; B65D 25/54; B65D 25/205

USPC ..... 206/459.1, 459.5, 453, 485, 586, 775, 206/776; 229/120.12, 120.17, 191, 198

See application file for complete search history.

(56) References Cited

U.S. PATENT DOCUMENTS

| | | | | | |
|---|---|---|---|---|---|
| 2,256,995 | A * | 9/1941 | Andres | B65D 5/5042 | 206/485 |
| 3,343,662 | A * | 9/1967 | Bendoff | B65D 81/07 | 206/499 |
| 3,871,546 | A * | 3/1975 | Thompson | B65D 9/14 | 206/335 |
| 3,960,313 | A * | 6/1976 | Sax | B65D 5/10 | 229/117 |
| 4,068,796 | A * | 1/1978 | Kullman, Jr. | B65D 5/001 | 229/191 |
| 4,326,633 | A * | 4/1982 | Schillinger | B65D 5/5014 | 206/418 |
| 5,005,705 | A * | 4/1991 | Combs | B65D 5/5045 | 206/419 |
| 6,880,313 | B1 * | 4/2005 | Gessford | B65B 9/026 | 53/415 |
| 7,293,694 | B2 * | 11/2007 | Weimer, Jr. | B65D 5/28 | 229/120.12 |

* cited by examiner

*Primary Examiner* — Luan K Bui
(74) *Attorney, Agent, or Firm* — Dinsmore & Shohl LLP

(57) ABSTRACT

A container for holding a plurality of articles each of which have a UPC code on a rear side. The container has a pair of alignment walls which extend from the bottom at an angle to the front wall. The alignment walls hold the articles at an angle to the front wall so that the UPC code is not visible from the front of the container.

17 Claims, 4 Drawing Sheets

CLEAR CONTAINER HOLDING MULTIPLE ARTICLES

CROSS-REFERENCE TO RELATED APPLICATIONS

This Application claims the benefit of U.S. Provisional Application 62/291,575 filed on Feb. 5, 2016.

FIELD OF THE INVENTION

The invention relates to packaging for multiple articles and more particularly to packaging which has alignment walls to support the articles at an angle to a front wall of the packaging.

BACKGROUND OF THE INVENTION

Clear containers having a generally rectangular shape that holds multiple of the same or similar articles are known. When these containers are packaging it is necessary to cover the individual bar code labels on individual articles to prevent merchants from scanning the barcodes on each individual article. This is generally accomplished through using opaque or colored paper, paper backing, or a label to hide the individual barcodes while still allowing the product information and other pertinent labeling information to be viewed.

Consequently, to keep the articles constantly in display condition and/or to keep the articles from shifting, one commonly used method is to shrink wrap the articles as a way to stabilize them during shipping. Another commonly used method is placing the articles in hard plastic containers to protect the contents while keeping the product in display condition. However, as is evident, the shipping process disturbs or agitates the multiple articles from their preferred display position in most packages, which often leaves the multiple articles in an unfixable, undesirable position, due to the lid being sealed. Accordingly, it remains desirable to have a container that can position the articles in such a way wherein the individual UPC is obscured and the product remains in the desirable shipping display position.

SUMMARY OF THE INVENTION

A multiple article display container is provided. The container is generally box shaped having two transparent walls to view the articles. The container has a bottom with a pair of container alignment walls which extend to position the articles at a 45° angle to a front wall. The articles are held in position such that the bar codes cannot be seen from the front.

In a preferred embodiment, the bottom is formed from flaps that interlock with another. Each flap has a tab portion which overlays opposite flap. A portion of tab portion is folded at a 90° from the bottom to form the alignment wall. A paper insert may be added to the inside of the container to obscure a back of the container.

The container may be provided with a label on the outside that extends to cover one sidewall and wraps around the fold line onto the bottom of the container. The label assists in locking all the bottom flaps into place and also provides for the overall container UPC barcode. Additionally, the label may contain other pertinent product information.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be better understood when read in conjunction with the following drawings where like structure is indicated with like reference numerals and in which:

DETAILED DESCRIPTION OF THE PREFERRED EMBODIMENTS

The invention relates to a multiple article container with a pair of alignment walls which extend from a bottom. The alignment walls support the articles at an angle so as to cover the individual articles universal product code (UPC) label. The container may also include a label covers a side wall which also assists in obscuring the individual articles UPC label while providing the UPC barcode for the container. Furthermore, the container may be constructed from a single blank with fold lines to assist in bending of the flaps.

Figure 1:
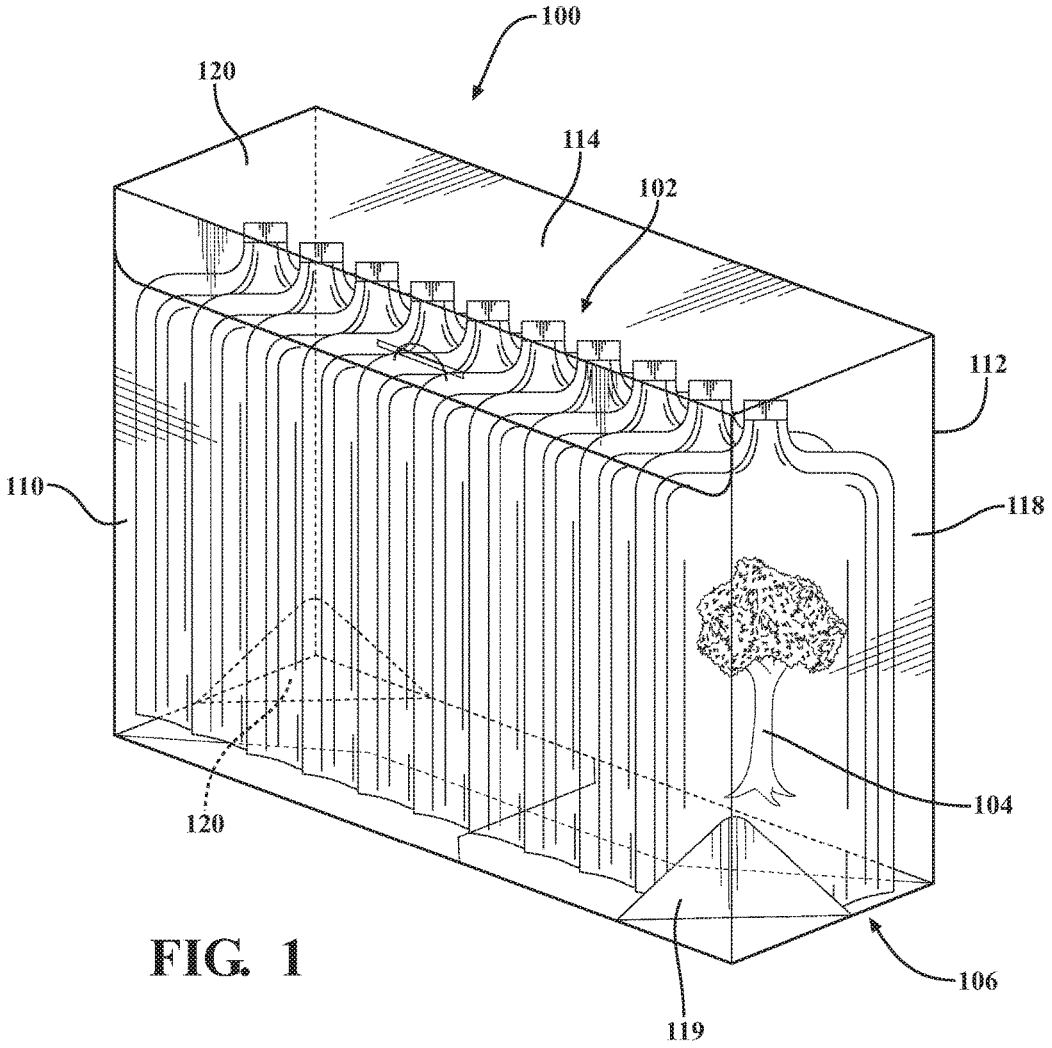
FIG. 1 is a perspective view of the display container illustrated with multiple articles.
Figure 2:
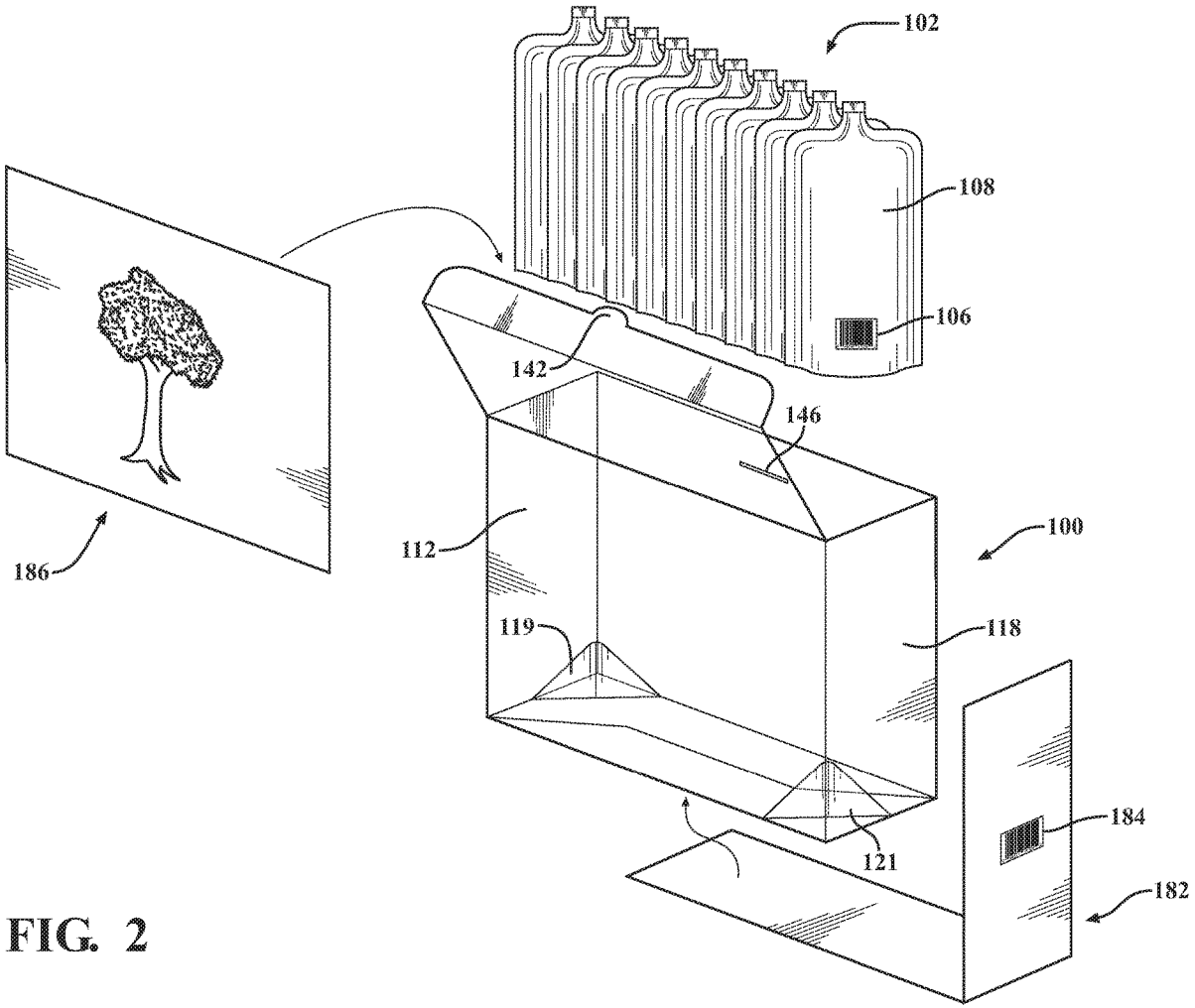
FIG. 2 is an exploded view of the container, articles.

As shown in FIGS. 1 and 2, the container 100 is configured to hold a number of articles such as "stand up" or Doyen style flexible pouches 102. The pouches 102 are generally rectangular in shape and include product information on a front wall 104 and a bar code or UPC code 106 on a back wall 108. Although shown holding pouches, the container is suitable for holding any articles having vertical rear panel having a bar code or UPC.

As shown in FIG. 1, the container 100 is a generally rectangular box with a front wall 110, rear wall 112, top 114, bottom 116 and a pair of sidewalls 118, 120. The articles 102 diagonally between the front wall 110 and rear wall 112. Thus, the distance between the front wall 110 and rear wall 112 is generally equal to the width of the article divided by $\sqrt{2}$. The top 114 is openable to provide access to the articles 102. The container 100 may be formed from a blank from a single sheet of plastic such as clear thermos plastic. The plastic sheet is flexible but sufficiently stiff to maintain a shape and is formed with fold lines to facilitate assembly. However, the container may be molded from one or several pieces.

Figure 3:
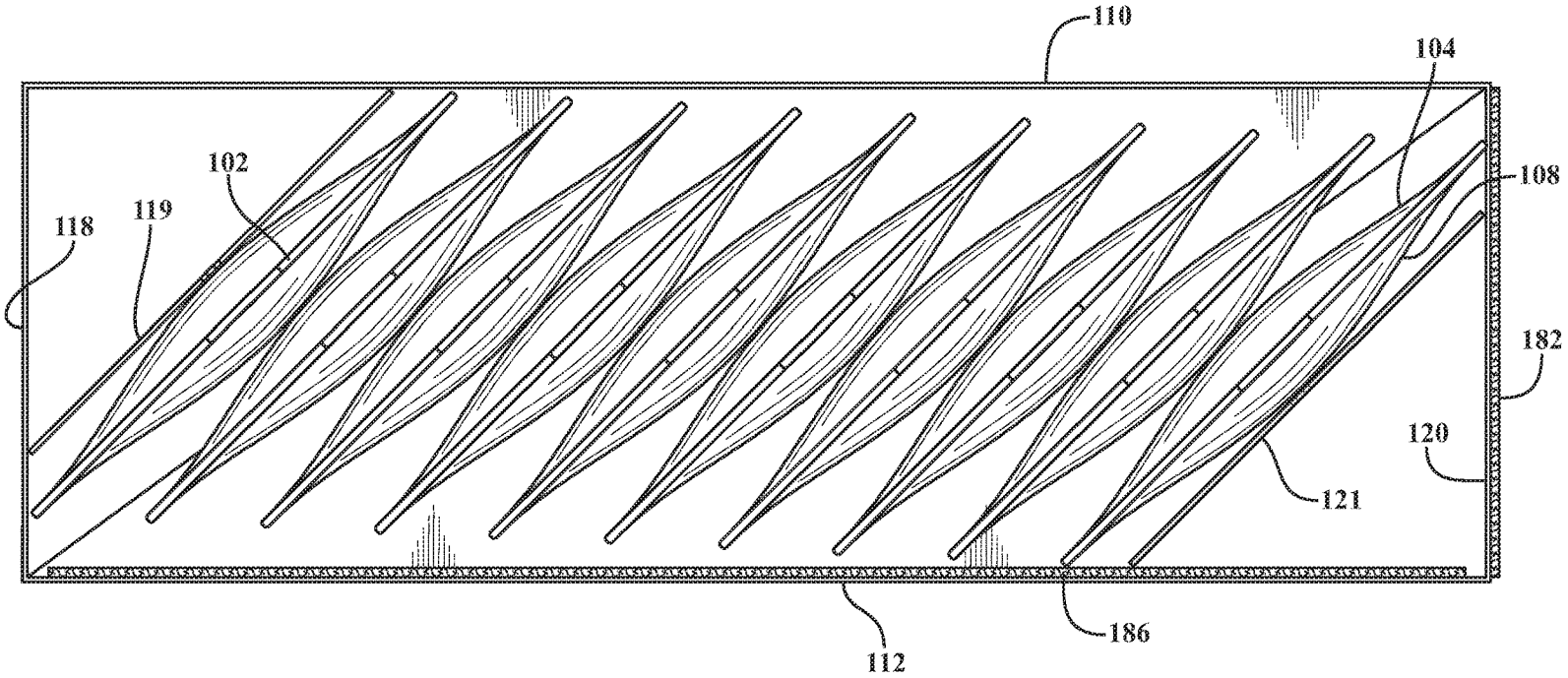
FIG. 3 is a top view of the container.

As shown in FIGS. 2 and 3, a pair of alignment walls 119, 121 extend upwardly into a cavity 123 defined by the walls 110, 112, 118, 120, and bottom 116. A respective alignment wall 119, 121 is located adjacent each side wall 118, 120. The alignment walls 119, 121 extend at an angle of 45° to the front wall 110. The distance between the alignment walls 119,121 is a multiple of the width of the articles 102 so that the articles are held securely in alignment within the cavity 123. The articles alignment of the permits the front 104 of the article 102 can be seen through the front wall 110 and one side wall 118 but the back 108 of the article 102 is not visible.

Figure 4:
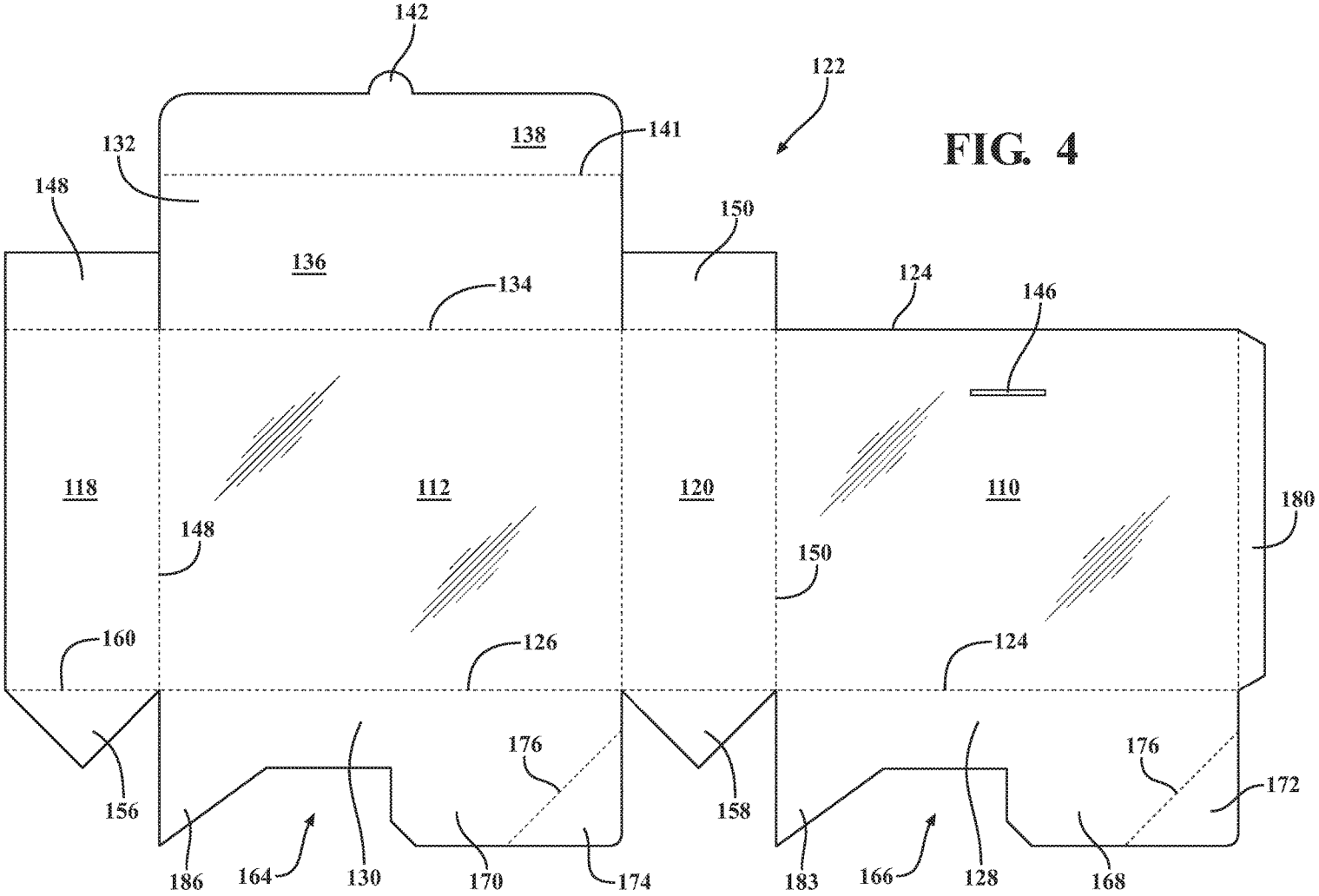
FIG. 4 is a view of a blank for producing the container.

As shown in FIG. 4 the container 100 may be assembled from a single blank 122. The blank 122 has a peripheral edge 124 defining the shape of the various flaps and lid. Fold lines are formed to define covers of the various panels and to facilitate the assembly of the blank 122 into the container 100.

The front wall 110 and back wall 112 have equal length and width and are defined at the bottom by a fold lines 124, 126 and which extend to define flaps 128, 130. A lid panel 132 extends from a first hinge 134. The lid panel has a first lid portion 136 to close the top and a second lid portion 138 to extend over the front 110 from second hinge 141. A lid tab 142 and is used to engage a receiving slot 146 in the front wall to lock into thus securing the lid 132. The slot 146 and tab 142 may be any complimentary shape. A seal (not shown) may be, without limitation, an oval clear sticker to help seal and keep the lid closed.

The first sidewall 118 is equal in length, width, and height to the second sidewall 120. Moreover, both sidewalls 118, 120 are defined by fold lines 148, 150. Top flaps 152, 154 extend from the fold lines 148, 150. The top flaps 148, 150 are used to help close the top opening. While the container 100 is illustrated as rectangular in shape, it should be appreciated that the container 100 shape may vary, such as, without limitation, as a square or as a hexagon and may contain a plethora of multiple articles.

The bottom 116 of the container 100 is formed by bottom flap 128, bottom flap 130, a first triangular side flap 156, and a second triangular side flap 158. The bottom flap 128 extends from first fold line 160. Each flap 128, 130 has a recess 164, 166 partially defining a tab portion 168, 170. A triangular portion 172, 174 is formed by fold lines 176, 178 on each tab. The triangular portions are folded upwardly to form the alignment walls 119, 121. A lower 180, 182. An extension portion 183, 185 extends under the flaps. Once positioned, each side flap 156, 158 is sealed with an adhesive to the extensions portions 180, 182. When assembled, the tabs 168, 170 are inserted through the recess 160, 162, to overlay the opposite flap 130 extends from fold line 162.

Now referring to FIGS. 1 and 3, the sidewalls 118, 120 front wall 110, and back wall 112 are held together by a container flap 180 that extends from the front wall 110 onto the inside of the first sidewall 118 where an adhesive is used to secure the flap 180 to the first side wall 118 thus fortifying the container is shape.

The front wall 110 and one sidewall 118 are transparent. The rear wall 112 and the other sidewall 120 are blocked to prevent viewing of the bar code. As shown in FIG. 2, a label 182 with adhesive extends to cover the bottom 116 and the second sidewall 120. Product information may be preprinted on the label 182 such as, without limitation, the contents of the container 100, or other branding and product information. The label 182 works to help hold the bottom flanges 128, 130 together while displaying product information including the master container UPC 184. The master container UPC 184 is the barcode used to scan the entire container as a single unit.

Now referring to FIG. 2, a preprinted insert 186 may be inserted between the articles 102 and the rear wall 112. The insert 186 may contain advertising or other information. Furthermore, the insert 186 may assist in obscuring the individual UPC of the articles 102 or provide for a background when viewing the product from the backside.

Obviously, many modifications and variations of the present invention are possible in light of the above teachings and may be practiced otherwise than as specifically described.

While particular embodiments have been illustrated and described herein, it should be appreciated that various other changes and modifications may be made without departing from the spirit and scope of the subject matter. Moreover, although various aspects of the claimed subject matter have been described herein, such aspects need not be utilized in combination.

The invention claimed is:

1. A container for holding a plurality of articles comprising:

a front wall, a rear wall spaced apart from the front wall, a bottom extending between the front wall and rear wall to define a cavity holding a plurality of articles, a pair of alignment walls integrally formed from the bottom and extending from the bottom into the cavity, the pair of alignment walls angled with respect to the front wall, the pair of alignment walls spaced apart to hold the plurality of articles therebetween, wherein each article of the plurality of articles is angled in a single row with respect to the front and rear walls.

2. The container of claim 1 further comprising:

a pair of sidewalls, and one sidewall of the pair of sidewalls and the rear wall being opaque.

3. The container of claim 1 wherein the bottom further comprises a pair of flaps.

4. The container of claim 3 wherein a portion of each flap forms one of the pair of alignment walls.

5. The container of claim 1 wherein one of the pair of alignment walls extends diagonally between the front wall and one side of a pair of side walls and the other one of the pair of alignment walls extending between the rear wall and the other of the pair of side walls.

6. The container of claim 1 further comprising:

an insert positioned between the articles and the rear wall.

7. The container of claim 1 further comprising:

a pair of sidewalls, and a label having a front portion and a bottom portion, the front portion is perpendicular to the bottom portion, the bottom portion of the label is configured to adhesively attach to the bottom and the front portion of the label extends beyond the bottom to cover one of the pair of side walls.

8. The container of claim 1 wherein the container is formed from a single blank.

9. The container of claim 1, wherein the pair of alignment walls are rigid.

10. A container for holding a plurality of articles, the container comprising:

a transparent front wall;

a rear wall spaced from the transparent front wall to partially define a cavity containing a plurality of articles;

a bottom having a pair of alignment walls integrally formed from the bottom and extending into the cavity, the pair of alignment walls are angled with respect to the transparent front wall and the rear wall, the pair of alignment walls spaced apart to accept the plurality of articles therebetween;

each of the plurality of articles having a back side, the back side of each of the plurality of articles having an individual UPC code, wherein each one of the plurality of articles are angled in a single row with respect to the front and rear walls such that the individual UPC code on the back side of each of the plurality of articles is blocked by an adjacent one of the plurality of articles to not be visible through the transparent front wall.

11. The container of claim 10 wherein the pair of alignment walls extend at generally 45 degrees with respect to the transparent front wall and the rear wall.

12. The container of claim 11 wherein the transparent front wall is spaced apart from the rear wall a predetermined distance equal to the width of the article divided by the √2.

13. The container of claim 12 further comprising:

a pair of sidewalls; and one sidewall of the pair of sidewalls and the rear wall are opaque and the other side wall is clear.

14. The container of claim 13 wherein the bottom is formed by a pair of flaps.

15. The container of claim 14 wherein each alignment wall is formed from one of the flaps.

16. The container of claim 14 wherein each flap has a recess and a tab portion.

17. The container of claim 10, wherein the pair of alignment walls are rigid.

* * * * *